US006488275B2

(12) United States Patent
Schlageter

(10) Patent No.: US 6,488,275 B2
(45) Date of Patent: Dec. 3, 2002

(54) ACTIVE PRE-REGISTRATION SYSTEM USING LONG SHEET TRANSPORTS

(75) Inventor: Alan G. Schlageter, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 68 days.

(21) Appl. No.: 09/739,129

(22) Filed: Dec. 18, 2000

(65) Prior Publication Data

US 2002/0074718 A1 Jun. 20, 2002

(51) Int. Cl.[7] ..... B65H 5/00
(52) U.S. Cl. ..... 271/10.01; 271/225; 271/227
(58) Field of Search ..... 271/225, 227, 271/228, 184, 199, 200, 10.83, 10.12, 162, 4.03, 10.01

(56) References Cited

U.S. PATENT DOCUMENTS

| | | | | |
|---|---|---|---|---|
| 4,971,304 A | | 11/1990 | Lofthus | 271/227 |
| 5,094,442 A | | 3/1992 | Kamprath et al. | 271/227 |
| 5,169,138 A | * | 12/1992 | Cordes | 271/225 |
| 5,278,624 A | | 1/1994 | Kamprath et al. | 355/317 |
| 5,697,609 A | | 12/1997 | Williams et al. | 271/228 |
| 6,135,446 A | * | 10/2000 | Thiemann et al. | 271/228 |
| 6,168,153 B1 | * | 1/2001 | Richards et al. | 271/227 |

FOREIGN PATENT DOCUMENTS

| | | | | |
|---|---|---|---|---|
| JP | 4-350038 | * | 12/1992 | 271/228 |
| JP | 6-1498 | * | 1/1994 | 271/227 |
| JP | 6-234441 | * | 8/1994 | 271/227 |

* cited by examiner

*Primary Examiner*—H. Grant Skaggs
(74) *Attorney, Agent, or Firm*—William Henry, II

(57) ABSTRACT

A pre-registration system increases the latitude of present active registration systems by decreasing the lateral offset of sheets before they reach the active registration system. This is accomplished by pivoting a long transport with a stepper motor in conjunction with sensing a lateral edge of the sheets in order to direct the sheets to the proper lateral position to be fed into the active registration system with a minimum of lateral offset.

12 Claims, 5 Drawing Sheets

ACTIVE PRE-REGISTRATION SYSTEM USING LONG SHEET TRANSPORTS

BACKGROUND OF THE INVENTION

Cross reference is hereby made to co-pending U.S. application Ser. No. 09/739,955 by Alan G. Schlageter which application is commonly assigned and entitled "Active Pre-Registration System Employing A Paper Supply Elevator".

1. Field of the Invention

This invention relates to positioning of sheets in an active registration system, and more particularly, to pre-registering of sheets before they reach the active registration system.

2. Description of Related Art

Sheet registration systems deliver sheets of all kinds to a specified position and angle for a subsequent function within a printer/copier. Functions could include transferring an image to a sheet, stacking the sheet, slitting the sheet, etc. Conventional registration system corrects for skew and lateral offset. Skew contributors may be sheet supply angle, skew induced when the sheet is acquired to the feeder, inboard-outboard drive roller velocity differences on a common drive shaft. Lateral offset may be due to sheet supply location and sheet drive direction error. Sheet drive direction error is caused by the sheet drive shafts not being perpendicular to the intended sheet drive direction. This is a result of tolerances and excess clearance between: drive shafts and frames, sheet transport mounting features and machine frames and machine module to module mounting. In present day high speed copier/printers, active registration systems are used to register the sheets accurately.

In printers/copiers where an active registration system is used, a sheet is passed over sensor arrays from which the sheet skew and lateral or cross process offset is calculated. At this point the sheet is steered into the proper position by rotating inboard and outboard nip rollers at different velocities. This function must be performed in a specific time and distance. As the sheet needs to be moved faster and faster to increase overall productivity, the time to register the sheet to correct for skew and lateral offset decreases. With this, the acceleration and velocities at the registration nips increase to a point of failure.

One such active registration system is disclosed in U.S. Pat. No. 5,094,442 to David R. Kamprath et al., issued Mar. 10, 1992 that registers sheets in a feed path without the use of guides or gates. Laterally separated drive rolls are speed controlled to correct for skew mispositioning. Lateral registration is achieved by translation of the drive rolls transversely to the direction of sheet movement. Varying the speeds of the drive rollers equally controls longitudinal registration. The system reduces the required sheet path length to achieve correct registration, thereby allowing higher speed operation.

A method and apparatus for an active sheet registration is shown in U.S. Pat. No. 4,971,304 issued Nov. 20, 1990 to Robert M. Lofthus, which provides deskewing, and registration of sheets along a paper path in the X, Y and θ directions. Sheet drivers are independently controllable to selectively provide differential and non-differential driving of the sheet in accordance with the position of the sheet as sensed by an array of at least three sensors. The sheet is driven non-differently until the initial random skew of the sheet is measured. The sheet is then driven differentially to correct the measured skew, and to induce a known skew. The sheet is then driven non-differentially until a side edge is detected, whereupon the sheet is driven differentially to compensate for the known skew. Upon final deskewing, the sheet is driven non-differentially outwardly from the deskewing and registration arrangement. A fourth sensor may be provided to measure the position of the sheet after registration with respect to desired machine timing.

U.S. Pat. No. 5,278,624 issued Jan. 11, 1994 to David R. Kamprath et al. shows a registration system for copy sheets that uses a pair of drive rolls and drive system for commonly driving both drive rolls. A differential drive mechanism is provided for changing the relative angular position of one of the rolls with respect to the other roll to deskew the copy sheet. A control system is supplied with inputs representative of the skew of the copy sheet and controls the differential drive mechanism to deskew the copy sheet.

A lateral sheet pre-registration device is shown in U.S. Pat. No. 5,697,609 issued Dec. 16, 1997 that includes a steerable pair of drive nips located in the paper path of an electrophotographic printing machine. A lead edge sensor detects when a sheet is within the steerable drive nips. The steerable nips are turned so that the sheet is transported toward a side registration sensor located in the paper path. When the side registration sensor detects the edge of the sheet an actuator causes the steerable nips to be straightened. The sheet may be forwarded to a second, higher accuracy registration device for final registration.

Even though the above-mentioned registration and pre-registration systems are useful, there is still a need to move sheets faster and faster to increase overall productivity, but the time to register the sheets to correct for skew and lateral offset decreases. With this, the acceleration and the velocities at the registration nip increase to a point of failure. One way to increase the latitude of the active registration system and decrease nip failure is to decrease the lateral offset.

SUMMARY OF THE INVENTION

Accordingly, pursuant to the features of the present invention, a method and apparatus is disclosed that answers the above-mentioned problem by providing an active pre-registration system that includes a pivoting long transport that is positioned by a stepper motor which is actuated in response to registration sensors to direct sheets to the proper lateral position. This will reduce, if not eliminate, the lateral offset and reduce the time and acceleration required registering the sheets.

This and other features and advantages of the invention are described in or apparent from the following detailed description on the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

Figure 1:
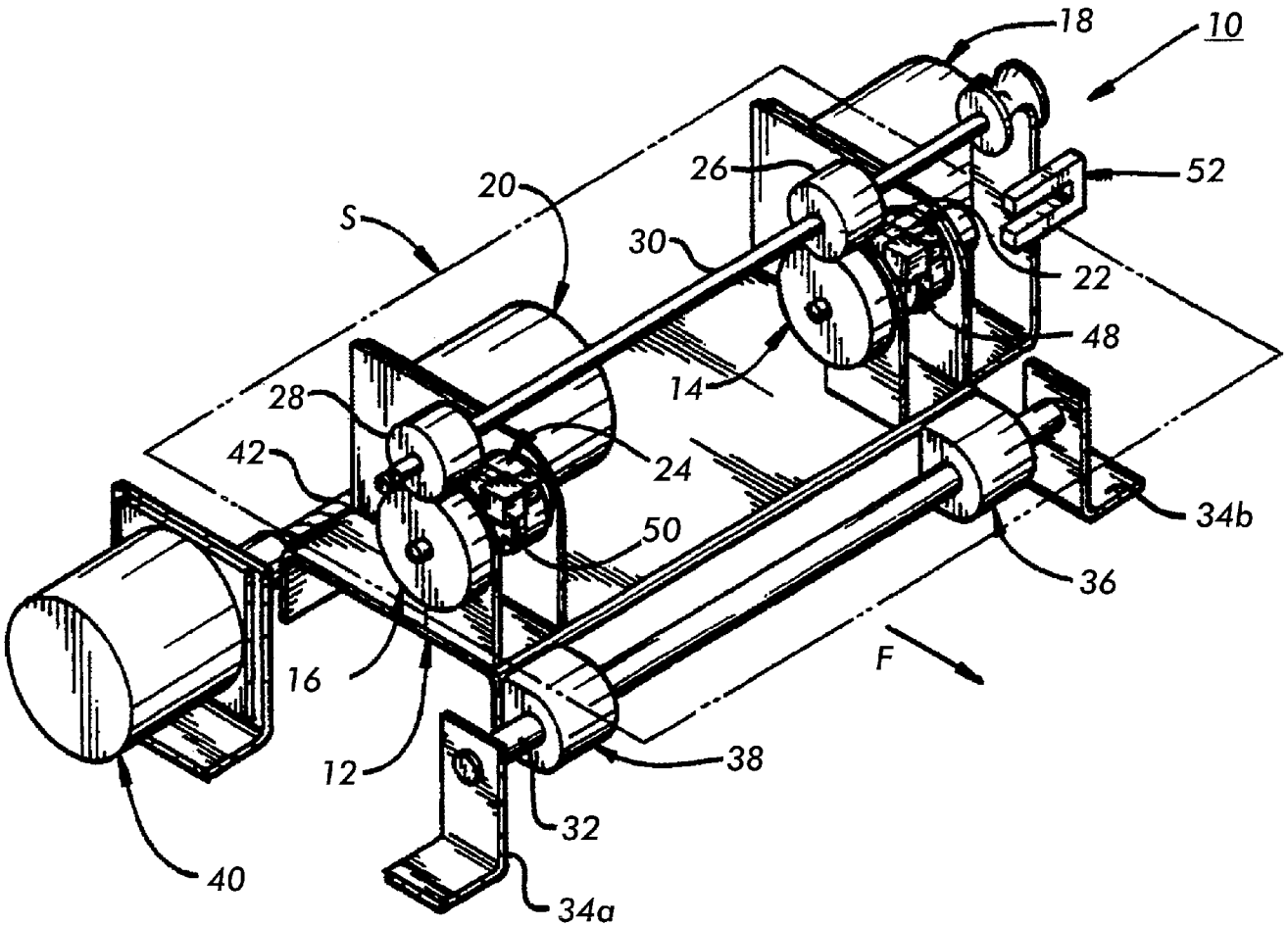
FIG. 1 (Prior Art)
FIG. 1 is an isometric view of a prior art sheet registration system.

FIG. 1 illustrates a prior art sheet registration system that places a sheet S into proper alignment or registration for a downstream processing as the sheet travels in the direction shown by arrow F. The registration unit 10 includes a carriage 12 having two drive rolls 14 and 16 rotatable mounted thereon by suitable means. The drive rolls 14 and 16 are driven by drive motors 18 and 20, respectively. The drive motors 18 and 20 are preferably speed controllable stepper motors, although other types of speed controllable servo motors are usable. The rotary output of each motor 18 and 20 is transmitted to the respective drive rolls 14 and 16 by suitable power transmission means, such as belts 22 and 24.

Above drive roll 14 is rotatably mounted by suitable means nip roll 26. A suitable nip roll 28 is mounted above drive roll 16. Advantageously, the nip rolls 26 and 28 are commonly coaxially mounted for rotation about the axis of a cross shaft 30, which is mounted on the carriage 12. The roll pairs 14, 26 and 16, 28 engage the sheet S and drive it through the registration unit 10.

The carriage 12 is mounted for movement transversely of the direction of feed indicated by arrow F. In the arrangement of FIG. 1, this is accomplished by mounting one edge of the carriage 12 on the guide 32, which extends perpendicularly to the direction of sheet feed. The guide 32 is supported on the frame on which the registration system is mounted by a pair of opposed supports 34*a* and 34*b*. A pair of bearings, 36 and 38, which are slidably received on the guide 32, mounts the carriage 12 on the guide 32.

Figure 2:
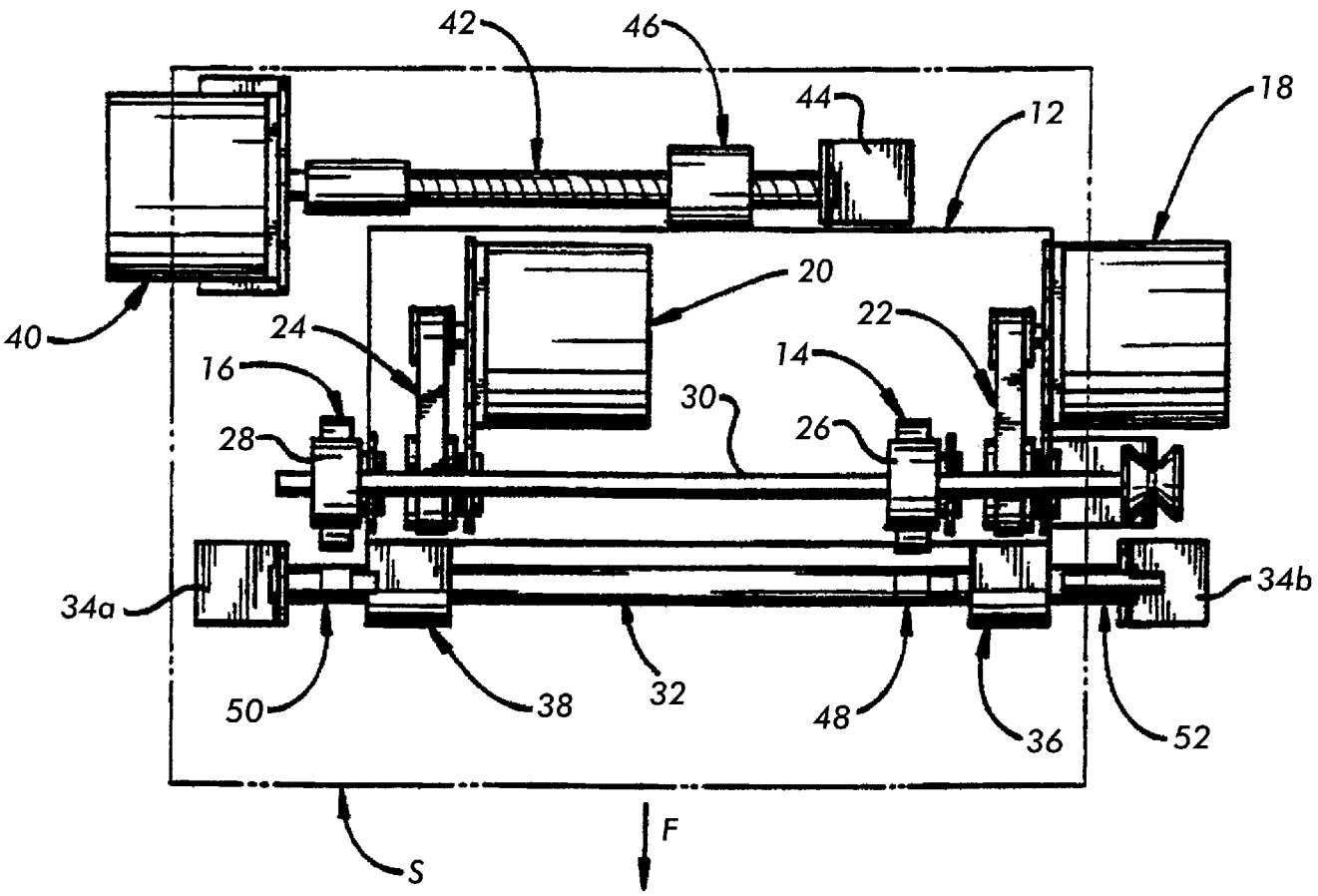
FIG. 2 (Prior Art)
FIG. 2 is a top plan view of the prior art sheet registration system shown in FIG. 1.

In FIG. 2, the carriage 12 is moved transversely of the feed path by a drive system including a speed controllable stepper motor 40 or other similar speed controllable servo motor. The output shaft of the motor 40 drives a lead screw 42, which is rotatably supported at the end opposite the motor by suitable bearing support 44. The motor 40 and support 44 are mounted on the frame of the equipment in which the registration system is used. A block 46 having an internally treaded bore is mounted on the carriage. The threads of he internal bore of the block 46 engage the threads of the lead screw and it will be readily appreciated that as the motor 40 rotates the lead screw 42, the carriage will be driven transversely as the block 42 travels along lead screw 42. The direction of rotation of motor 40 governs the direction of movement of the carriage 12.

Also, with respect to FIG. 1, the registration system includes detectors for detecting the position of the sheet with respect to the registration system. Preferably, the detectors are optical detectors, which will detect the presence of edges of the sheet S. For lead edge detection of the sheet, two detectors 48 and 50 are mounted on the carriage 12 adjacent the drive rolls 14 and 16, respectively. The detectors 48 and 50 detect the leading edge of the sheet S as it is driven past the sensors. The sequence of engagement of the sensors 48 and 50 and the amount of time between each detection is utilized to generate control signals for correcting skew (rotational mispositioning of the sheet about and axis perpendicular the sheet) of the sheet by variation in the speed of the drive rolls 14 and 16.

A top or lateral edge sensor 52 is suitably mounted by conventional means on the frame of the equipment on which the registration system is mounted. This optical detector is arranged to detect the top edge of the sheet and the output therefrom is used to control transverse drive motor 40. The basic logic of operation provides that, if the sensor 52 is covered by the sheet, the motor 40 will be controlled to move the carriage to the left (FIG. 1). If, on the other hand, one of the sensors 48, 50 indicates the presence of the leading edge of the sheet, and if sensor 52 remains uncovered, then the motor 40 provides drive to move the carriage 12 rightwardly. In the preferred arrangement, the carriage is driven past the transition point, at which the lateral edge of the sheet is detected by change of state of sensor 52. Then the drive is reversed to position the lateral edge at the transition point.

Figure 3:
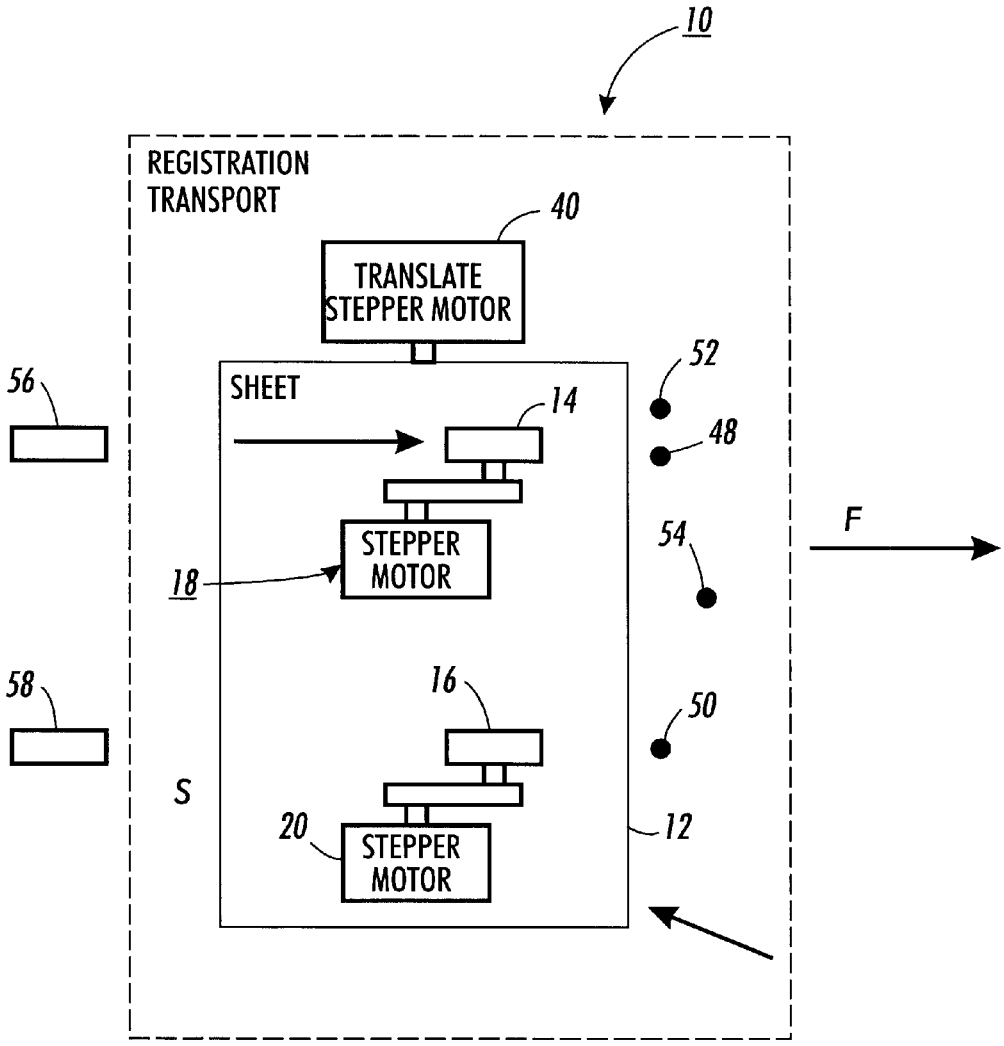
FIG. 3 (Prior Art)
FIG. 3 is a schematic illustration of a prior art sheet positioner showing the placement of sheet location sensors.

A schematic illustration of a top view of a registration system showing the positioning of the sensors is shown in FIG. 3. This arrangement shows a fourth sensor 54, which maybe an optical sensor, mounted in the feed path of the sheet S to detect the position of the lead edge of the sheet. The arrival time of the leading edge of sheet S at sensor 54 is compared with a reference signal, for example, one occurring after skew correction is complete, to derive a process error correcting value. This value is compared with a desired value and the velocity of the two rolls 14 and 16 is temporarily increased or decreased so that the leading edge of the sheet reaches a desired point in the feed path in synchronization with a downstream operation. In this fashion, the registration system performs a gating function. In high-speed systems, particularly ones for handling large sheets, it is desirable to employ releasable nip rolls 56 and 58. These rolls drive the sheet to the point where the registration system begins making adjustments to the position of the sheet. At that point, the rolls 56 and 58 are released so that the sheet is free to be moved under the influence of drive rolls 14 and 16 and the translating carriage 12. Such releasable nip roll arrangements are known in the art and no further explanation thereof is necessary.

Figure 4:
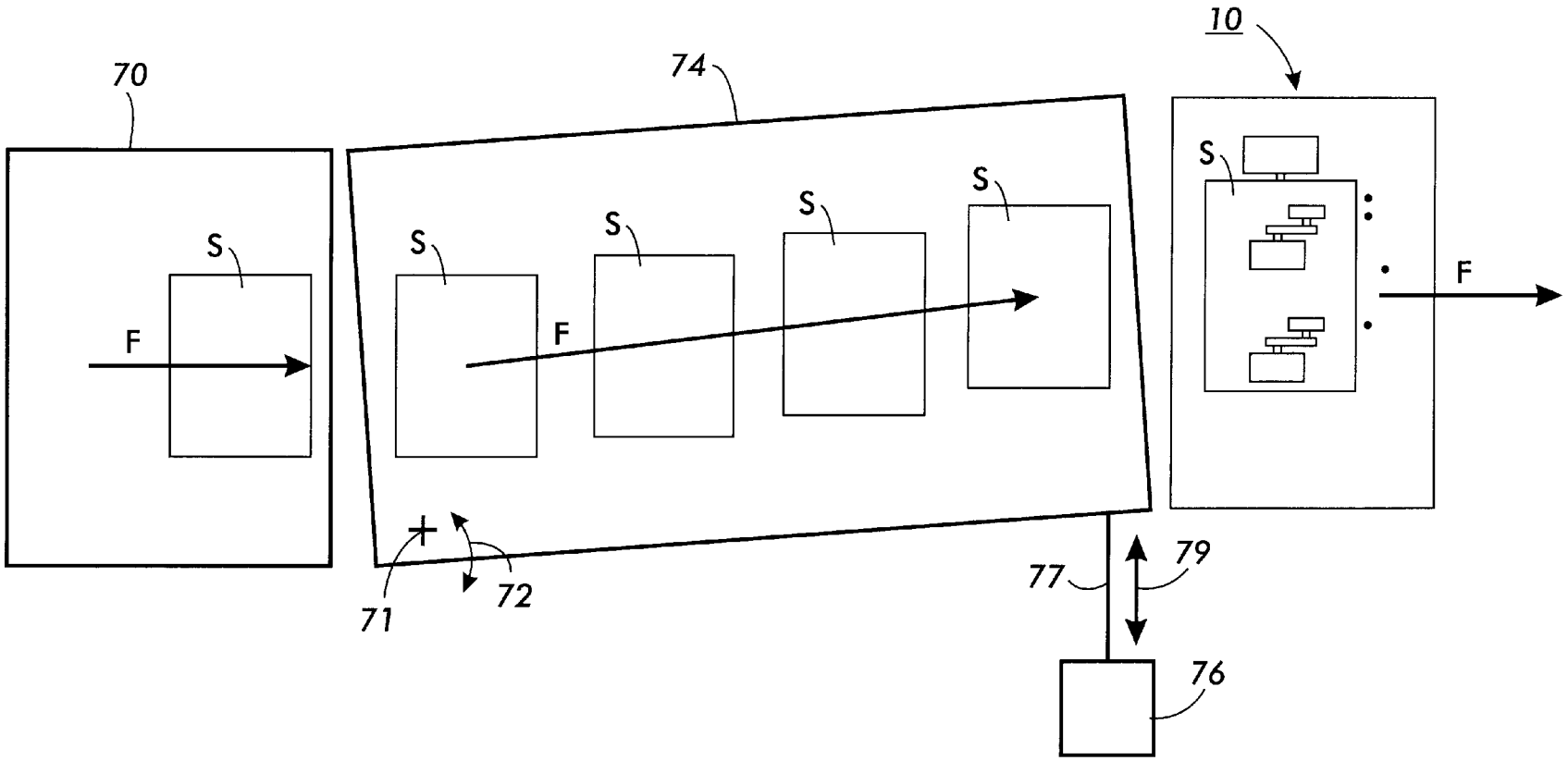
FIG. 4 is a schematic plan illustration of the pre-registration transport of the present invention.

In order to increase the latitude of the heretofore described active registration to meet present day demands for higher speed and increased productivity from printer/copiers, and in accordance with the present invention, an active pre-registration system is shown in FIG. 4, that decreases the lateral offset of sheets before they reach the registration system. Thus, the time to register sheets and the distance of sheet movement at the registration station are reduced. In FIG. 4, elevator supported sheets S are fed by conventional means, such as feed rolls (not shown) from sheet input transport 70 in the direction of arrow F onto pivoting transport 74 which could be a conventional ball-on-belt, vacuum or belt-on-belt transport. It should be understood that the pivoting transport 74 could be part of a duplex return transport, a print engine bypass transport or any transport prior to an active registration system.

Upon initial machine setup, pivoting transport 74 is positioned at a nominal position. After a sheet passes through the pivoting transport 74 into the active registration unit 10, registration sensors 48, 50 and 52 determine the inboard and outboard position and angular position. The sheet position is determined and the data is passed through an algorithm with the use of a controller shown in FIG. 5. The proper position of pivoting transport 74 is determined that would enable the sheet to reach registration unit 10 in an optimum position and the transport is pivoted to the proper position in order to minimize sheet correction required at the registration unit. Pivoting of transport 74 about pivot point 71 in either one of the directions of arrow 72 is accomplished by actuation of stepper motor 76. Stepper motor 76 is actuated in response to a signal from a controller 59 in FIG. 5 through pivoting transport stepper circuit 60 after the controller has processed signals from lateral edge sensor 52. Once actuated, stepper motor 76 rotates lead screw 77 in one of the directions of arrow 79 in order to rotate pivoting transport 74 and laterally align sheets as close as possible to an optimum side edge position. If desired, this stepper motor and lead screw function could be accomplished through a number of conventional mechanisms or through manual adjustment at machine install. This routine is followed until sheets enter the registration unit 10 at a location that optimizes the registration function.

It is contemplated that sheet location can be monitored throughout the life of the machine in which it is installed and as components wear, the position of the pivoting transport can be adjusted to keep sheets entering the registration unit at the optimum position.

Figure 5:
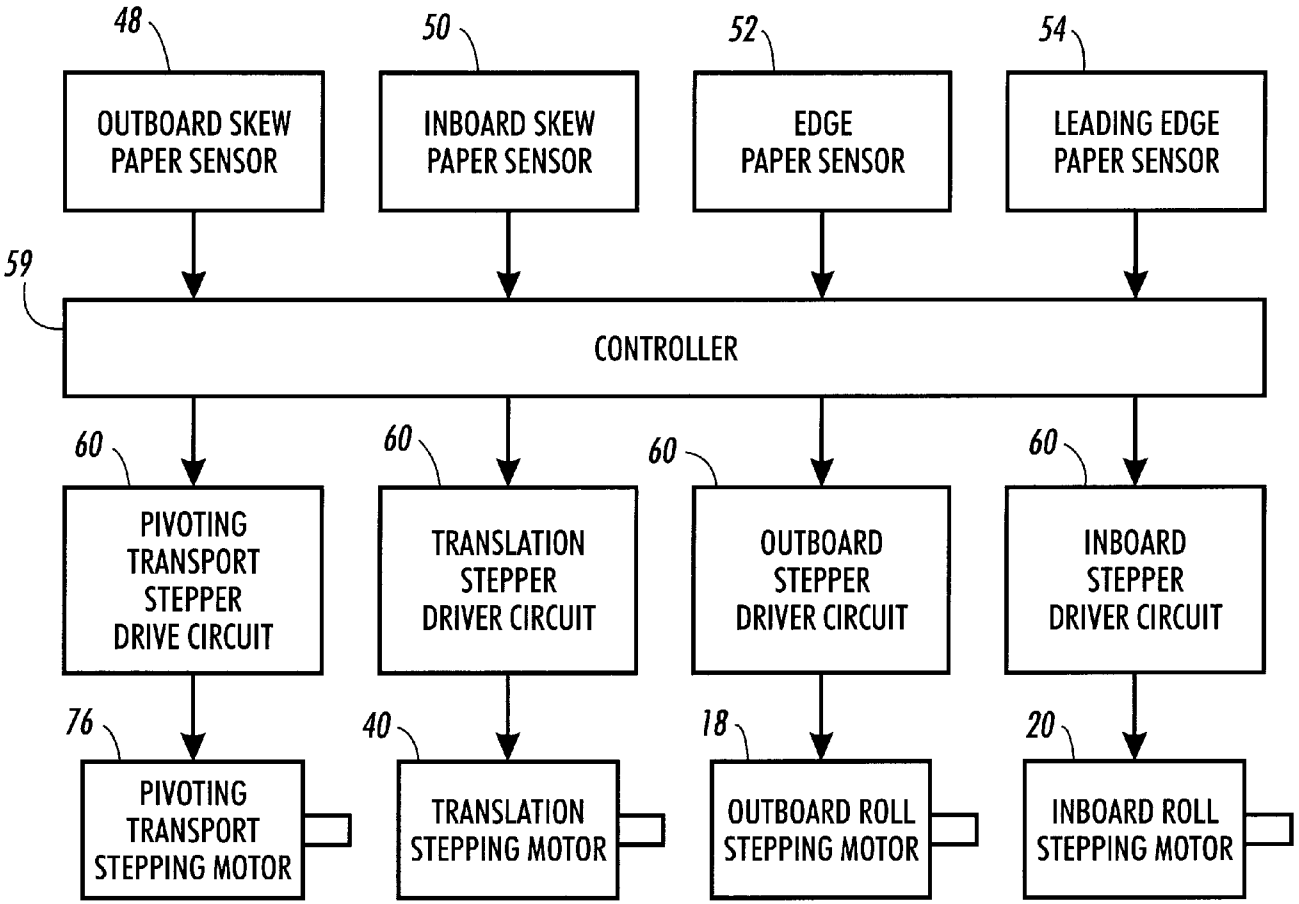
FIG. 5 is a block diagram of control circuitry for one form of the pre-registration and registration apparatus.

Control for the pre-registration and registration systems of FIGS. 1–4 is shown in FIG. 5. Signals from the edge sensors 48, 50, 52, and 54, are provided to a controller 59. In a preferred arrangement, sensors 48 and 50 are utilized for both skew correction and longitudinal gating. For high speed or accuracy, sensor 54 is provided for deriving signals necessary for longitudinal gating.

Controller 59 can be a typical microprocessor programmed to calculate correction values required and provide control outputs for effecting appropriate action of the stepper motors 18, 20, 40, and 76. Suitable driver control circuits 60 are known in the art and no further detailed explanation is necessary.

It should now be understood that a low cost, active pre-registration system has been disclosed that will increase the latitude of present active registration systems by pre-registering sheets with the use of a pivoting transport to align sheets with a registration unit. It will increase the life of the registration components by reducing the acceleration forces incurred during registration by reducing the lateral offset into the registration unit. The pre-registration system of the present invention will also increase the life and service intervals of paper path components by compensating for wearing parts by pivoting the transport to different locations as necessary.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A pre-registration apparatus, comprising:

a sheet input device, said sheet input device being adapted to support a stack of sheets and feed sheets seriatim therefrom;

a pivotable transport adapted to receive and support sheets from said sheet input device while transporting them to a downstream registration unit;

a device for pivoting an end portion of said pivotable transport laterally;

a lateral edge sensor which senses the lateral edge of moving sheets transported by said pivoting transport; and a controller adapted to receive a signal from said lateral edge sensor and in turn actuate said device to thereby pivot said pivotable transport to an optimum position.

2. The pre-registration apparatus of claim 1, wherein said sensor is an optical sensor.

3. The pre-registration apparatus of claim 1, wherein said device for pivoting said pivotable transport is a stepper motor.

4. The pre-registration apparatus of claim 3, including a lead screw rotatably connected to said stepper motor and said pivoting transport such that actuation of said stepper motor rotates said lead screw which in turn pivots said pivotable transport.

5. Apparatus for pre-positioning sheets en route to a registration unit, comprising:

a source for supporting a stack of sheets and feeding the sheets individually in a predetermined direction;

a pivoting transport adapted to support and transport sheets from said source to the registration unit;

a device adapted to rotate an end portion of said pivoting transport laterally in a predetermined direction;

a sheet lateral edge sensor positioned downstream of said source; and a controller adapted to receive a signal from said lateral edge sensor and in turn actuate said device to rotate said pivoting transport to an optimum position for transporting sheets to the registration unit with a minimum of lateral offset.

6. The apparatus of claim 5, wherein said sensor is an optical sensor.

7. The apparatus of claim 5, wherein said device is a stepper motor.

8. The pre-registration apparatus of claim 7, including a lead screw rotatably connected to said stepper motor and said pivoting transport such that actuation of said stepper motor rotates said lead screw which In turn pivots said pivotable transport.

9. A method for pre-registering sheets transported to a downstream registration location, comprising the steps of:

providing a sheet input device which supports a stack of sheets and feeds them individually therefrom;

providing a pivotable transport for receiving and supporting sheets from said sheet input device and transporting them to a downstream registration location;

providing a driving device for pivoting said pivotable transport;

sensing a lateral edge of sheets transported by said pivoting transport; and actuating said driving device in response to said sensing of the lateral edge of the sheets to thereby pivot said pivotable transport and move an end portion thereof laterally to an optimum position.

10. The method of claim 9, wherein said sensing of a lateral edge of sheets is accomplished with an optical sensor.

11. The method of claim 9, wherein said driving device for pivoting said pivotable transport is a stepper motor.

12. The method of claim 11, including the step of providing a lead screw rotatably connected to said stepper motor and said pivoting transport such that actuation of said stepper motor rotates said lead screw which in turn pivots said pivotable transport.

* * * * *